US005908228A

United States Patent [19]

Lee

[11] Patent Number: 5,908,228

[45] Date of Patent: Jun. 1, 1999

[54] DOOR OPENING/CLOSING HANDLE APPARATUS FOR A REFRIGERATOR

[75] Inventor: Yeon-Hark Lee, Suwon, Rep. of Korea

[73] Assignee: Samsung Electronics Co., Ltd., Suwon, Rep. of Korea

[21] Appl. No.: 08/912,982

[22] Filed: Aug. 12, 1997

[30] Foreign Application Priority Data

Aug. 14, 1996 [KR] Rep. of Korea ..... 96-24461

[51] Int. Cl.[6] ..... A47B 95/02

[52] U.S. Cl. ..... 312/405; 312/296; 49/478.1; 49/319; 292/251.5

[58] Field of Search ..... 312/405, 401, 312/222, 296; 49/478.1, 319; 292/DIG. 71, 251.5, 182, DIG. 19; 62/440

[56] References Cited

U.S. PATENT DOCUMENTS 2,659,115 11/1953 Anderson et al. ..... 292/251.5 X
2,970,857 2/1961 Squire ..... 292/251.5
3,195,880 7/1965 Ritchey ..... 292/251.5 X
4,590,710 5/1986 Newland ..... 49/478.1

*Primary Examiner*—Peter M. Cuomo
*Assistant Examiner*—Janet M. Wilkens
*Attorney, Agent, or Firm*—Burns, Doane, Swecker & Mathis, L.L.P.

[57] ABSTRACT

A refrigerator includes a cabinet and a door. The door includes a gasket which, when the door is closed, is held by magnetic force against the cabinet. A handle assembly mounted on the door includes a finger-actuated lever which can be actuated by a user's finger to displace a slide which initially pushes open the door by a predetermined distance sufficient to separate the gasket from the cabinet. Then the door can be opened by pulling easily on a rigid part of the handle that is fixed to the door.

10 Claims, 2 Drawing Sheets

DOOR OPENING/CLOSING HANDLE APPARATUS FOR A REFRIGERATOR

BACKGROUND OF THE INVENTION

1. Field of the Invention

The present invention relates to a door handle apparatus for a refrigerator in which freezing and cooling chamber doors are held closed by magnetic force.

2. Description of the Prior Art

A conventional refrigerator, as illustrated in FIG. 1, includes: a door 30A hinged on one side of a cabinet 20 for opening and closing a front opening of the refrigerator chamber 10; a gasket 40A mounted at an inner edge of the door and being in contact with the cabinet 20 to prevent the cold air in the refrigerator chamber 10 from leaking outside the refrigerator when the door is closed; a rubber encased magnet 50A mounted within the gasket 40A to stick the gasket fast to the cabinet 20 by its magnetic force; and a gripping door handle 60 mounted at one side of the door for opening and closing the door.

However, there is a problem in the conventional refrigerator thus constructed in that as the door handle 60 is fixedly installed on an outer side of the door, a strong pull is required in order for the gasket 40A and the cabinet 20 to be separated from one another to thereby open the door because they stick fast together due to a magnetic force of the magnet 50A.

Further, there is another problem in the conventional refrigerator thus constructed in that vibration is generated as the door snaps opened, so that various foods stored in an inner guard of the door collide with each other to thereby drop from the guard.

SUMMARY OF THE INVENTION

Accordingly, the present invention is provided to solve the aforementioned problem and it is an object of the present invention to provide a refrigerator in which a user's finger generates a force enabling a door to be initially opened by a predetermined distance between a gasket and a cabinet, which are surface-contacted with each other due to a magnetic force generated by a magnet encased within the gasket. The door is subsequently opened by pulling the door with only a slight force, so that vibration in the refrigerator does not happen when the door is opened, thereby preventing the foods stored in the refrigerator door from colliding with and dropping from the door.

In order to accomplish the above object, the present invention provides a refrigerator having a door held closed by a magnetic force generated from a magnet installed within a gasket, the improvement comprises:

door handle means by which a user can separate the cabinet and the gasket by a predetermined distance using the force of a user's finger, before opening the door completely.

BRIEF DESCRIPTION OF THE DRAWINGS

For a fuller understanding of the nature and objects of the invention, reference should be made to the following detailed description taken in conjunction with the accompanying drawings, in which.

DETAILED DESCRIPTION OF A PREFERRED EMBODIMENT OF THE INVENTION

Figure 1:
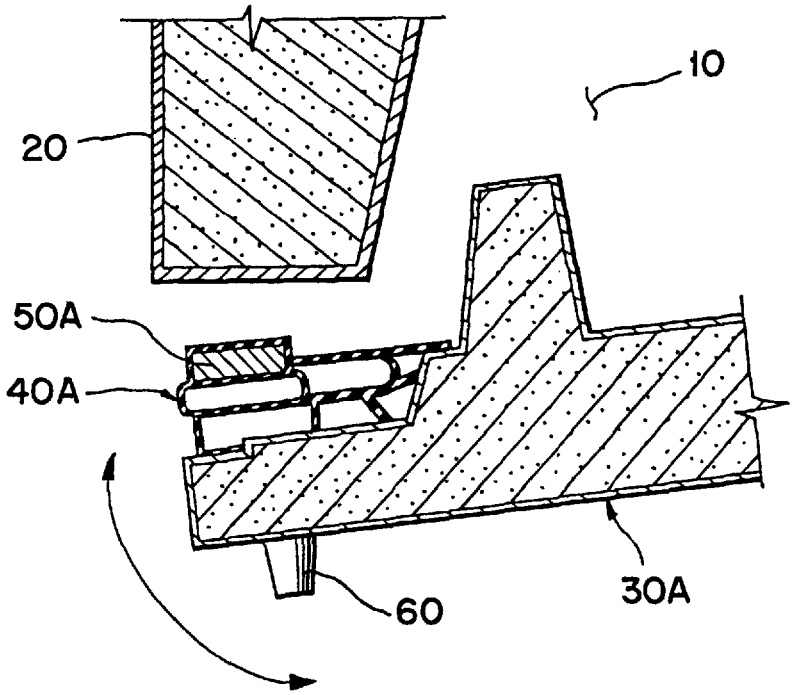
FIG. 1 (PRIOR ART)
FIG. 1 is a sectional view for illustrating a door of a refrigerator mounted with a door handle thereon according to the prior art.

An embodiment of the present invention will now be described in detail with reference to the accompanying drawings. Throughout the drawings, like reference numerals and symbols are used for designation of like or equivalent parts or portions for simplicity of illustration and explanation, and redundant reference will be omitted.

Reference numeral 100, in the drawings, designates door handle means installed at one side of the door 30 for easily opening the door 30 by the gripping force of a user's finger in a state in which the gasket 40 is held closed against a cabinet 20 by a magnetic force generated from a rubber-encased magnet 50 installed within the gasket 40.

Figure 2:
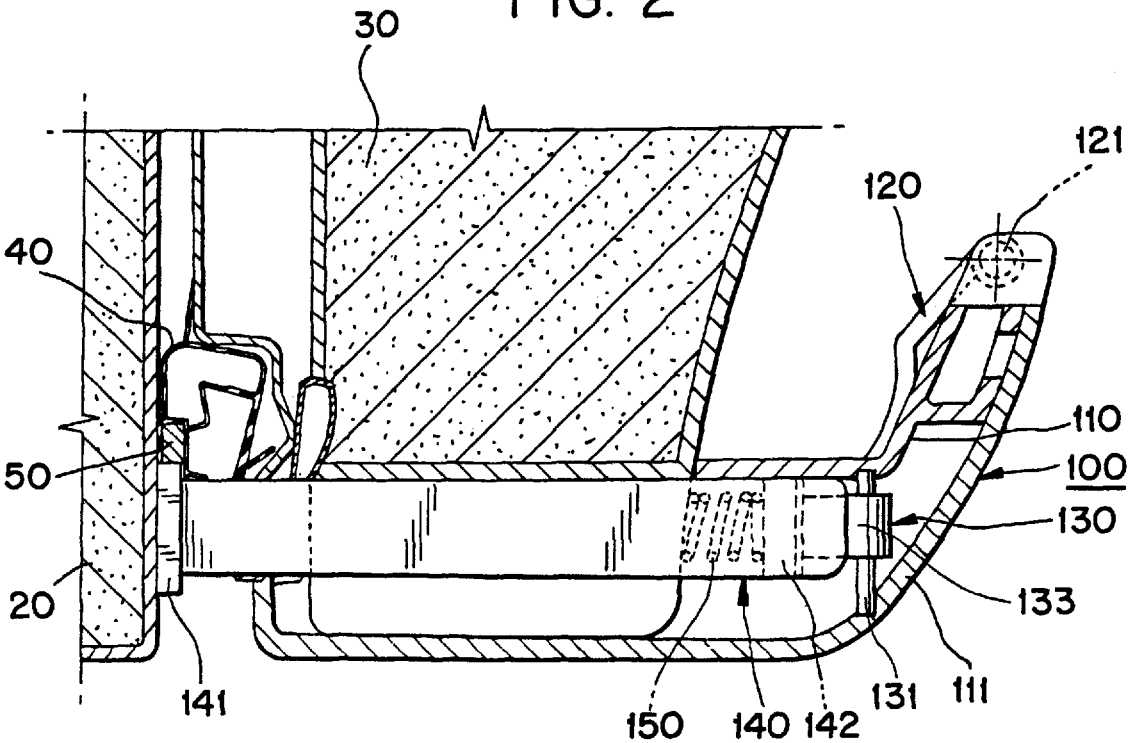
FIG. 2 is a sectional view for illustrating a door handle apparatus according to the present invention.
Figure 3:
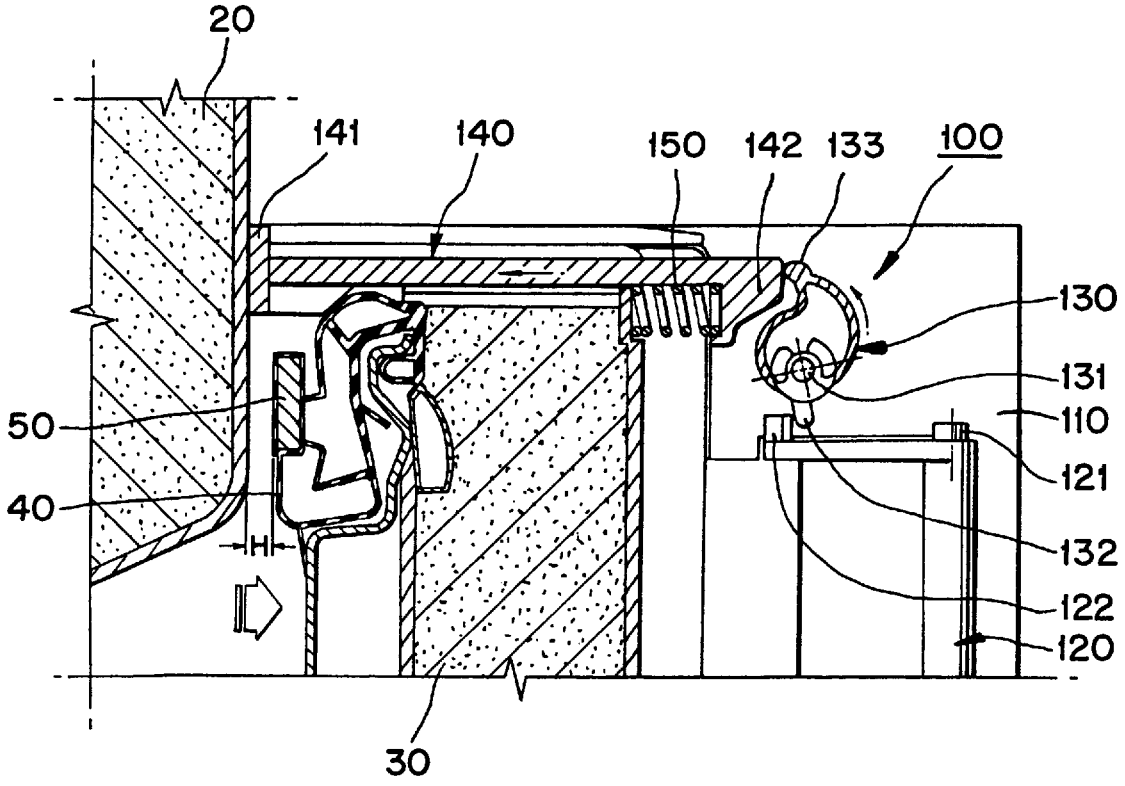
FIG. 3 is a lateral sectional view for illustrating a door-open state of the door handle apparatus according to the present invention.
Figure 4:
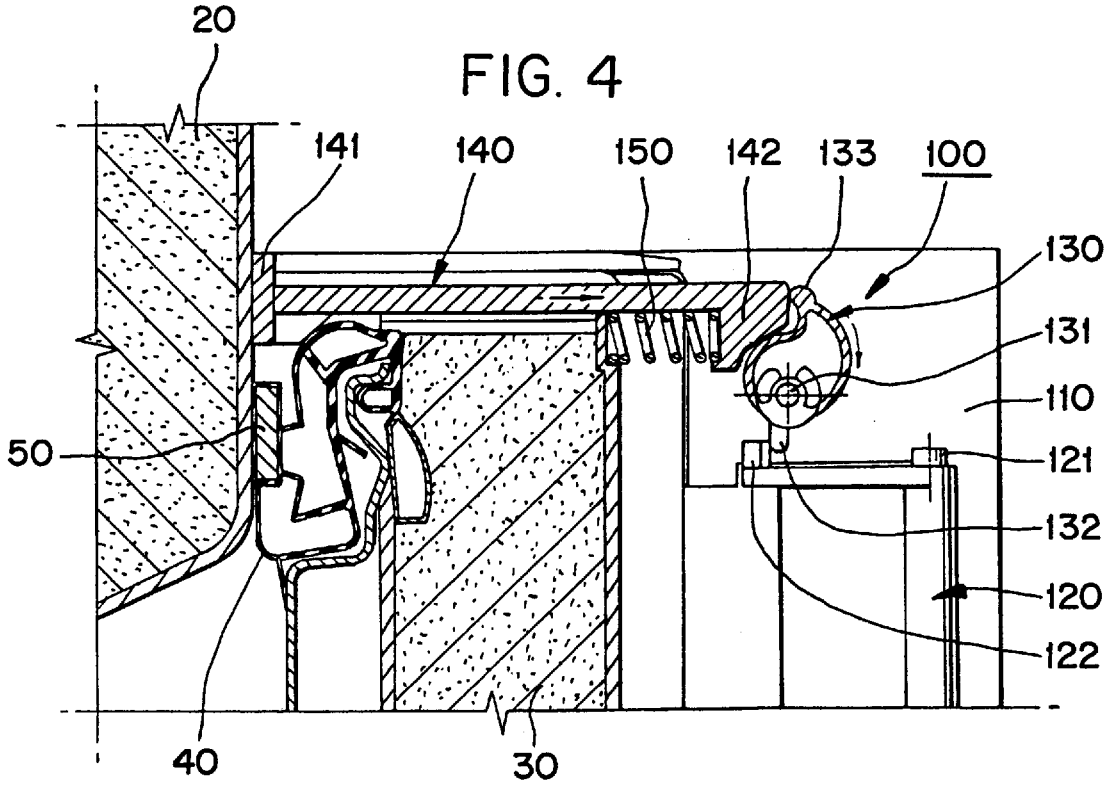
FIG. 4 is a lateral sectional view for illustrating a door-closed state of the door handle apparatus according to the present invention.

That is, the door handle opening and closing apparatus 100, as shown in FIGS. 2, 3 and 4, includes: a hollow handle unit comprised of inner and outer handles 110 and 111 installed at one side of the door 30 for opening the door 30 by a pulling force, a lever member 120 movably pivoted on the door; a rotating cam 130 pivoted on the door for pivoting when the lever member 120 is pulled by a user's finger; a slide 140 mounted on the door for pushing against the cabinet 2 and separating a magnetic contact between the cabinet 20 and the gasket 40 in response to rotation of the rotating cam 130; a spring 150 for restoring the slide 140 and cam 130 to the original state when the lever 120 is released.

The inner and outer handles 110 and 111 are connected to each other and fixed to a lateral side of the door 30. Portions of the handles, to which the lever 120 is attached, are spaced from the door and extend parallel with the front side of the door 30. The handles form a chamber between one another.

The lever member 120 is provided at one of its sides with a hinge protruder 121 integrated therewith so as to be combined with a free end of the handle unit where the inner and outer handles 110 and 111 are joined to one another, and is provided at the other side with a push protruder 122 for abutting one side of the rotating cam 130.

The rotating cam 130 is pivoted through the medium of a pivot pin 131 within the chamber formed between the inner and outer handles 110. The cam 130 is provided at one side of its circumference with a first protruder 132 for being contacted by the push protruder 122 of the lever member 120, and is provided at the other side of its circumference with second protruder 133 for contacting one side of the slide 140.

The slide 140 is provided a first end thereof with a broad contact surface 141 for surface-contacting one side of the cabinet 20, and is provided at the opposite end with a spring stop 142 having an intermediate surface for supporting one end of the spring 150, so that the slide 140 can be restored to its original state by an elastic force.

Next, the operation of the apparatus thus constructed will be described.

In order to open the door 30, as shown in FIG. 2, a user grasps the inner and outer handles 110 and 111, and at the same time, presses the lever member 120 with a slight force of a finger, whereupon the lever 120 turns on an axis of the hinge protruder 121 until the push protruder 122 abuts the first protruder 132.

At this time, the push protruder 122 serves to push the first protruder 132 in a direction away from the cabinet 20 and to rotate the rotating cam 130 through the medium of the pivot pin 131, and at the same time, causes the second protruder 133, which is positioned circumferentially opposite to the first protruder 132, to turn on the axis of the pivot pin 131. That is, the first and second protruders 132 and 133 of the rotating cam 130 move like a seesaw.

In addition, the second protruder 133 serves to push the slide 140 against the cabinet 2. That causes the magnet 50 to move in a direction away from the cabinet 20 until there is a predetermined distance "H" between the cabinet 20 and the magnet 50, as shown in FIG. 3.

In other words, the second protruder 133 serves to push the slide 140, but the slide 140 does not move toward the cabinet 20 but rather is continuously in surface contact with the cabinet 20 whenever the door is in a closed state, so that the operation of the slide 140 causes the cabinet 20 and the gasket 40 to be separated from one another at a predetermined interval (H) even with a slight force.

The spring 150 is pressed by the spring stop 142 positioned at the rear portion of the slide 140 to thereby be compressed by the same predetermined distance as that of the gap (H) between the magnet 50 and the cabinet 20.

In this state, when a user pulls the inner and outer handles 110 and 111, the door 30 is easily opened without the magnetic force being exerted by the magnet 50. Accordingly, no vibration is generated, thereby preventing various foods stored in the guard (not shown) provided at the inner side of the door 30, from colliding with each other and dropping from the guard.

Meanwhile, in order to shut the door 30, the lever member 120 is released, as shown in FIG. 4, whereupon the spring 150 serves to push the slide 140 and cam 130 to their original state.

At this time, the slide stops when the contact surface 141 contacts the cabinet 20. The push protruder 122 is correspondingly restored to its original state when the first protruder 132 is restored to its original state. The lever member 120 turns on the axis thereby returning to the original state.

As has been described in the foregoing, according to the invention, the refrigerator is provided with a door handle in which a surface contact, generated by a strong magnetic force, between the cabinet and the magnet is eliminated when the door handle is gripped with a finger's slight force before the door is subsequently pulled open, thereby preventing a vibration of the refrigerator, so that foods mounted in the door are prevented from dropping or colliding with each other.

What is claimed is:

1. A refrigerator comprising:

a cabinet forming a refrigerating compartment for storing food;

a door hinged to the cabinet;

a gasket including a magnet for releasably holding the door against the cabinet by magnetic force; and a door-opening assembly mounted on the door, the door-opening assembly including a handle unit fixed to the door for enabling the door to be manually pulled open, a finger-actuated element mounted on the handle unit and movable relative thereto by a user's finger, and a force-transmitting mechanism for converting movement of the finger-actuated element into a pushing force against the cabinet for opening the door by a predetermined amount sufficient to separate the gasket and magnet from the cabinet, the force-transmitting mechanism including a slide engaging the cabinet whenever the door is in a closed state, and arranged to be pressurized against the cabinet in response to actuation of the finger-actuated element.

2. The refrigerator according to claim 1 wherein the finger-actuated element comprises a lever pivoted to the handle unit.

3. The refrigerator according to claim 2 wherein the door-opening assembly further comprises a rotary cam mounted for rotation on the handle unit, the cam including a first portion rotatable by the finger-actuated element, and a second portion for pressurizing the slide in response to being rotated by the finger-actuated element.

4. The refrigerator according to claim 3 wherein the handle unit is hollow and forms a chamber; the cam, and a portion of the slide being disposed in the chamber.

5. The refrigerator according to claim 4 wherein the handle unit includes a portion spaced from the door and extending substantially parallel thereto, that portion of the handle unit terminating in a free end; the pivot of the lever defining an axis coinciding with that free end.

6. The refrigerator according to claim 3 wherein the first and second portions of the rotary cam comprise protrusions spaced substantially diametrically apart.

7. The refrigerator according to claim 1 wherein the door-opening assembly further comprises a spring for biasing the slide in a direction opposite a direction in which the slide is displaced during a door-opening operation.

8. The refrigerator according to claim 1 wherein the slide includes a first end for engaging the cabinet, an opposite end for receiving a pushing force, and an intermediate surface disposed between the first and opposite ends; the door-opening mechanism further including a spring for pushing against the intermediate surface and biasing the slide in a direction opposite a direction in which the slide is displaced during a door-opening operation.

9. The refrigerator according to claim 1 wherein the handle unit is hollow and forms a chamber, a portion of the force-transmitting mechanism being situated in the chamber.

10. A refrigerator comprising:

a cabinet forming a refrigerating compartment for storing food;

a door hinged to the cabinet;

a gasket including a magnet for releasably holding the door against the cabinet by magnetic force; and a door-opening assembly mounted on the door, the door-opening assembly including a handle unit fixed to the door for enabling the door to be manually pulled open, a finger-actuated element mounted on the handle unit and movable relative thereto by a user's finger, and a force-transmitting mechanism for converting movement of the finger-actuated element into a pushing force against the cabinet for opening the door by a predetermined amount sufficient to separate the gasket and magnet from the cabinet, the handle unit being hollow and forming a chamber, a portion of the force-transmitting mechanism being situated in the chamber.

* * * * *